US005791511A

United States Patent [19]

Lowing

[11] Patent Number: 5,791,511

[45] Date of Patent: Aug. 11, 1998

[54] DISPENSING MACHINE FOR PRINTED PUBLICATION

[75] Inventor: C. Rankin Lowing, Mobile, Ala.

[73] Assignee: DPC International, Inc., Ireland

[21] Appl. No.: 727,946

[22] Filed: Oct. 9, 1996

Related U.S. Application Data

[63] Continuation-in-part of Ser. No. 623,998, Mar. 29, 1996.

[51] Int. Cl.[6] ..... G07F 11/00

[52] U.S. Cl. ..... 221/6; 221/14; 221/17; 221/155; 221/151; 221/227; 221/258; 221/279

[58] Field of Search ..... 221/6, 7, 14, 17, 221/18, 155, 226, 227, 258, 279, 195, 280, 151, 153

[56] References Cited

U.S. PATENT DOCUMENTS

| | | | |
|---|---|---|---|
| 2,371,316 | 3/1945 | Rice et al. | 221/153 |
| 2,546,352 | 3/1951 | Weaver | 221/155 |
| 4,131,213 | 12/1978 | Tamura et al. | 221/155 |
| 4,312,461 | 1/1982 | Godley | 221/195 |
| 5,209,336 | 5/1993 | Heltzen et al. | 221/155 |
| 5,400,919 | 3/1995 | Gomm et al. | 221/225 |

FOREIGN PATENT DOCUMENTS

| | | | |
|---|---|---|---|
| 0581076 | 2/1994 | European Pat. Off. | G07F 11/42 |
| 0685827 | 12/1995 | European Pat. Off. | G07F 11/42 |
| 2117786 | 10/1972 | Germany | G07F 11/42 |
| 90/12377 | 10/1990 | WIPO | 221/279 |

*Primary Examiner*—H. Grant Skaggs
*Attorney, Agent, or Firm*—Keaty & Keaty

[57] ABSTRACT

The invention relates to vending machines for dispensing of a single copy of a printed publication one-at-a-time. The vending machine is self contained, is provided with a power source, a driving motor and a control unit for operation of the vending machine. An inclined platform plate mounted within the vending machine carries a plurality of media units, while a push plate forces the media units toward a dispensing channel located adjacent a forward edge of the platform plate. When a single copy of the media unit moves through the dispensing channel, a light sensor sends a signal to the control unit which causes reversal of movement of the push plate, thereby preventing accidental dispensing of the next copy of the media unit by gravity. After an entire inventory of the media units resting on a platform plate has been dispensed, a limit switch sends a signal to the control unit allowing vending of a display copy. A tilt switch detects tilting of the vending machine beyond a predetermined limit and actuates a chute block gate member that blocks the dispensing channel to prevent dispensing of the media units in case of vandalism.

21 Claims, 4 Drawing Sheets

DISPENSING MACHINE FOR PRINTED PUBLICATION

CROSS REFERENCE TO RELATED APPLICATIONS

This application is a continuation in part of my co-pending application Ser. No. 623,998 filed on Mar. 29, 1996, entitled "Dispensing Machine for Newspapers and Magazines", a full disclosure of which is incorporated by reference herein.

BACKGROUND OF THE INVENTION

The present invention relates to vending machines, and more particularly to a machine for dispensing printed publications, one copy at a time.

It is conventional to position newspaper and magazine dispensing machines on busy public streets, in lobbies of public buildings, to maximize exposure of the printed publications to the public. Generally, newspaper and magazine dispensing machines are provided with a hollow storage housing with a pivotally connected front door that opens in response to the deposit of the necessary amount of coins into a specially provided slot. The deposit of coins releases the latch mechanism that normally closes the front door and allows the buyer to correctly move the front door and remove one copy from the stack of publications.

Such design suffers from major drawbacks, one of which is easy accessibility to the entire inventory of newspapers or magazines to a buyer who deposited the amount of money to cover only one copy of the publication. As a result, vending machine operators suffer considerable commercial loses with this type of vending machine.

To solve this problem, various designs of vending machines were suggested. These machines are designed to restrict access of the public to the entire inventory of printed publications located in the housing of the vending machines. One such solution is shown in U.S. Pat. No. 5,400,919 issued on Mar. 28, 1995. In accordance with that patent, folded newspapers are advanced along an inclined platform by a push-plate which supports a stack of folded newspapers. Individual copies of the newspaper are advanced to a vending position by operation of a roller which engages the foremost single copy and brings it into alignment with a hopper plate descending downwardly from the platform. After a customer pays for a copy of the newspaper, a single copy is allowed to fall through the hopper to an access slot for recovery by the customer. A sensor positioned in the hopper wall sends a signal to a control mechanism to allow activation of the roller and depositing of the next copy into the vend position, from which the next customer can retrieve a copy after the trap door opens. Such a design, while being an improvement over prior designs, still suffers from some disadvantages. For example, the trap door on which the fold of the newspaper rests while the newspaper is in the vending position, is located very close to the access opening from which the newspaper is withdrawn by the buyer. Additionally, the entire inventory of the media units is positioned very close to the vending position. The design in accordance with '919 patent requires provision of a special bailer which acts in combination with cam/step motor unit to retain the forwardmost newspaper copy in a generally vertical orientation.

The present invention contemplates elimination of drawbacks associated with conventional vending machines and provision of an apparatus suitable for dispensing newspapers or magazines, one copy at a time, with a specially provided means for dispensing the last copy of the publication, which is conventionally positioned behind a display window of the housing.

SUMMARY OF THE INVENTION

It is, therefore, an object of the present invention to provide a vending machine for dispensing of a single copy of a printed publication, one at a time.

It is another object of the present invention to provide a media unit dispensing apparatus which is self-contained, so as to allow positioning of the unit indoors or outdoors, without connection to a source of A/C power.

It is a further object of the present invention to provide a vending machine which is designed to allow dispensing of the display copy of the publication after the entire inventory of the publications has been dispensed.

It is still a further object of the present invention to provide a vending machine which is designed to minimize the danger of vandalism and vendor's financial loss to a vendor due to theft of publications.

These and other objects of the present invention are achieved through a provision of a vending machine which comprises a platform plate, on a top surface of which a plurality of media units are supported. A push plate slidably moves above the platform plate, pushing the media units to a dispensing channel after a predetermined amount of money has been deposited into the vending machine.

Mounted within the dispensing channel is a means for detecting movement of the single copy of the media unit through the dispensing channel, said means comprising a light source and a light sensor mounted opposite the light source. When the single copy of the media unit moves through the dispensing channel, the flow of light is temporarily disrupted and a signal is sent to a central control means to cause a reversal of movement by the motor which allows the push plate to move slightly back. As a result, the media units are allowed to move slightly back along an inclined platform plate, and accidental dispensing of the next copy of the media unit by gravity is prevented.

The vending machine is provided with an anti-vandalism feature which prevents dispensing of any media unit when the vending machine is violently shaken or tilted beyond a predetermined degree. The anti-vandalism means provides for the use of a blocking gate, or door, which is mounted in general alignment with the top surface of the platform in the dispensing channel. The block door, or gate, is normally open, allowing dispensing of the media units through the dispensing channel. A tilt switch which is operationally connected to the door sends a signal to the control unit when the vending machine is tilted. As a result, the trap door is allowed to move to a position blocking the dispensing channel and preventing the dispensing of the media units.

The vending machine is further provided with a means for dispensing a display copy of the media unit after the entire inventory of the media units resting on the platform plate have been dispensed. The means for dispensing the display copy comprises a support plate which is mounted behind a display window and supports the display copy above the dispensing channel. A securing pin normally retains the support plate in a horizontal position, but allows the support plate to pivotally move to a second position, causing the display copy to drop into the dispensing channel after a limit switch mounted on a platform plate has been activated, signaling that there are no more copies left on the platform plate. The securing pin moves out of engagement with the support plate in response to the signal which is processed by the central control unit.

BRIEF DESCRIPTION OF THE DRAWINGS

Reference will now be made to the drawings, wherein like parts are designated by like numerals, and wherein.

DETAILED DESCRIPTION OF THE PREFERRED EMBODIMENT

Figure 1:
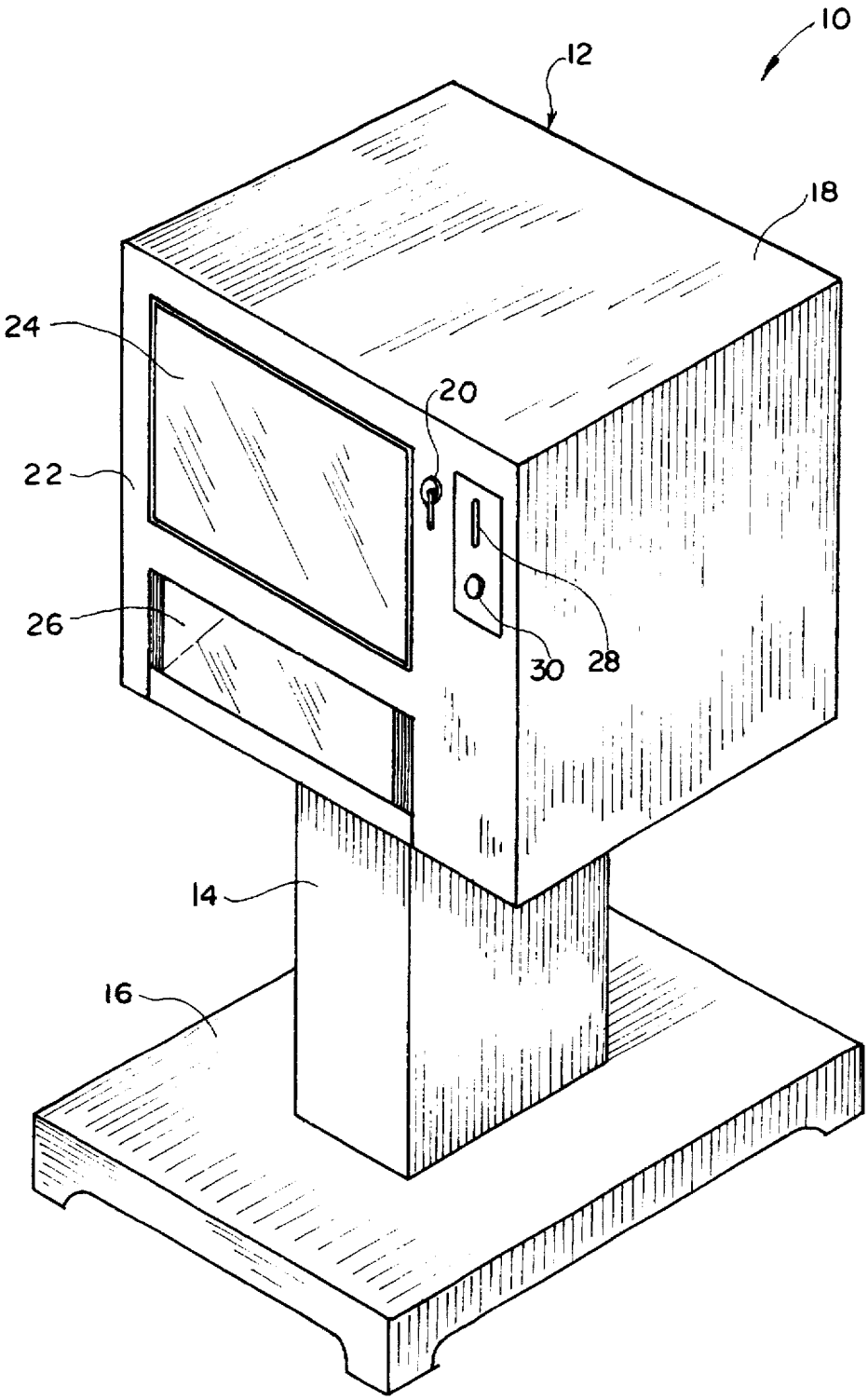
FIG. 1 is a perspective view of a vending machine in accordance with the present invention.

Referring now to the drawings in more detail, numeral 10 designates a vending machine in accordance with the present invention. The apparatus comprises a hollow housing 12 supported by a pedestal 14 on a horizontal weighted base 16. The housing wall has a generally rectangular configuration and has a closed bottom, closed side walls and a top access door 18, which can be hingedly connected to the top edge of the housing wall along the back of the housing or along a side wall of the housing. The access door 18 is locked in its position by a suitable lock and key mechanism 20 located on a front wall 22 of the housing 12. The front wall 22 is provided with a transparent display window 24 made of strong, shatter-proof material, such as acrylic or Lexan®, behind which a displayed copy of a publication, for example a newspaper, is positioned to allow the buyer to view the publication title and a portion of the front page of the publication.

Formed below the display window 24 is a dispensing opening 26 that allow a buyer to remove a purchased copy of the publication. The access opening 26 can be sized to correspond to the largest size publication to be stored in the housing 10 and is high enough to prevent damage or creasing of the copy being withdrawn from the opening 26.

On the front wall 22 is a coin receiving opening 28 into which the buyer drops the coins. The coins are received by a coin-counting mechanism positioned on the interior side of the wall 22. A return lever 30 is located below the opening 28 to allow the buyer to obtain return of the coins.

Figure 2:
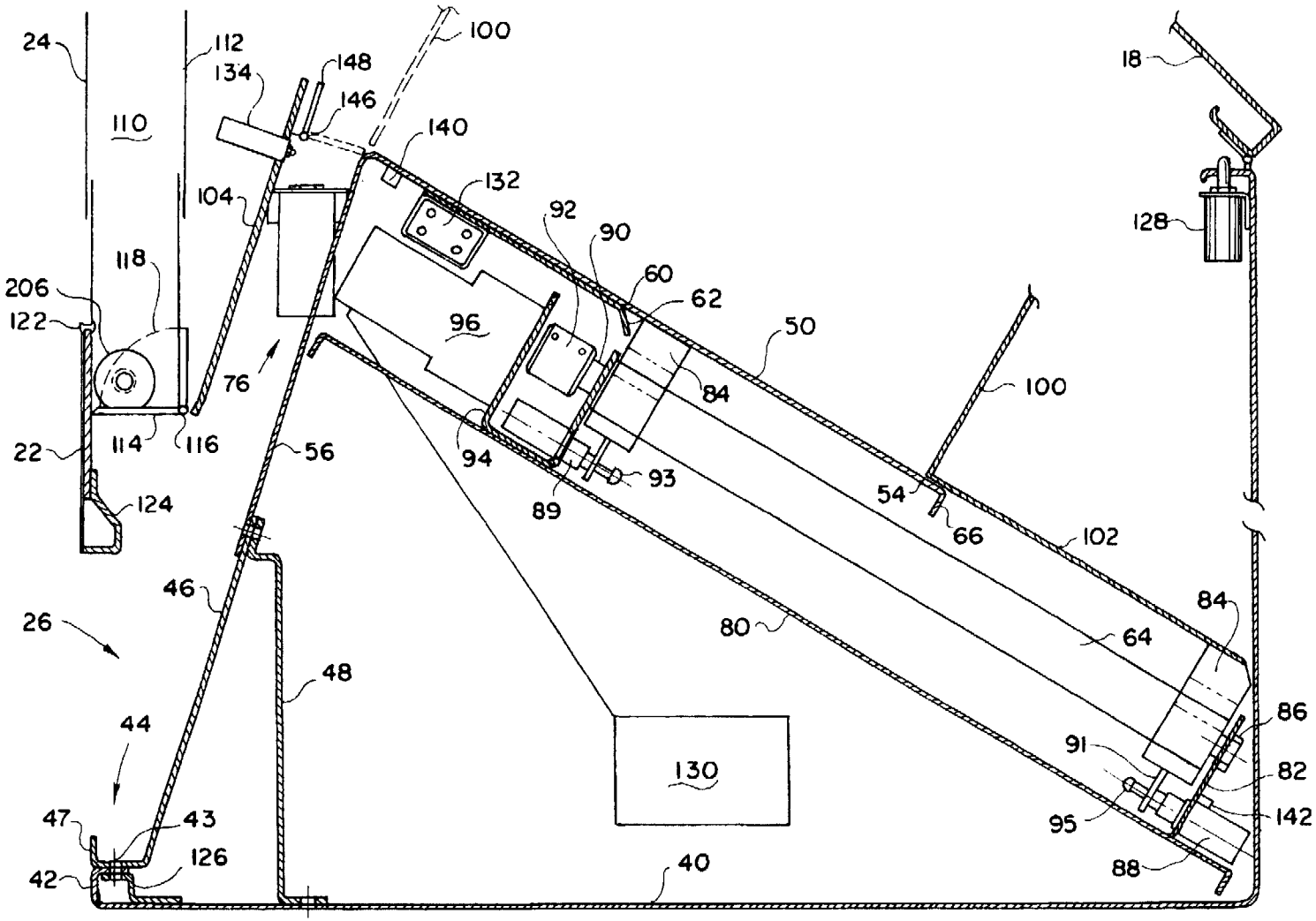
FIG. 2 is a schematic view of the operating mechanism of the vending machine in accordance with the present invention.

Turning now to FIG. 2 of the drawings, the operation of the vending machine 10 will be described in more detail. As can be seen in FIG. 2, a bottom wall 40 extends through substantially the entire depth of the housing 12 and carries a transversely oriented lip 42 at a forwardmost edge thereof. A dispensing pocket 44 is formed by an inclined plate 46, along which a copy of a publication slides by gravity, into the dispensing pocket 44. One end 47 of the plate 46 is bent upward to allow the publication to remain within the pocket 44 until withdrawn by a buyer. The plate 46 is secured to the lip 42 by a bolt or rivet 43.

Figure 3:
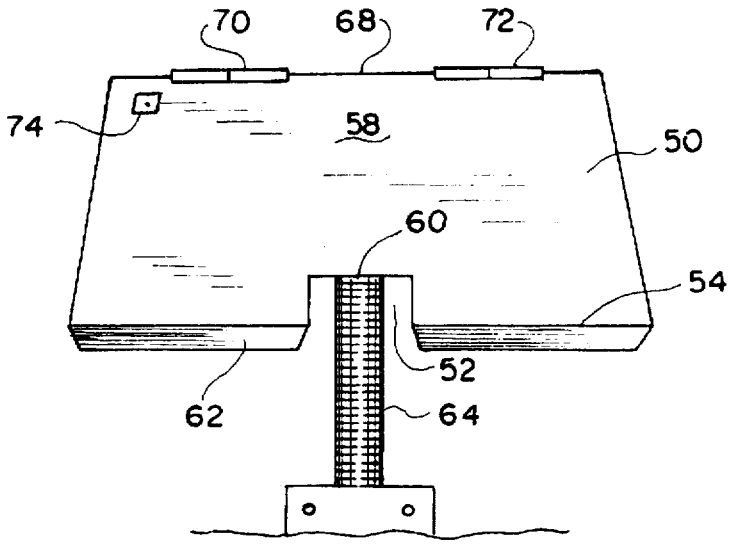
FIG. 3 is a detail top view of a platform of the vending machine in accordance with the present invention.

Securely attached to the bottom plate 40 is an outwardly, vertically extending inner wall 48, which carries a platform plate 50 at its upper end. The platform 50 is comprised of a solid plate with a central cutout 52 formed in its distant end 54 (see FIG. 3). An inner portion 56 of the platform plate 50 is bent at an angle and extends downwardly from the top surface 58 of the platform plate 50, to a distance where it is secured to an upper ends of the inner plate 48 and the plate 46, as shown in FIG. 2.

The cutout 52 is defined by an inner edge 60 with a turned down lip 62. The size of the cutout 52 allows movement of nut 84 therein. The distant end 54 of the plate 50 is provided with a downwardly turned flange 66 which extends at a right angle to the top surface 58 of the plate 50.

Mounted along an inner edge 68 of the platform plate 50 are one or more metering breaks 70, 72. (See FIG. 3.) The metering breaks 70, 72 are comprised of a solid body having a slightly elevated and inclined top front surface, along which the newspapers or magazines travel prior to dispensing. If desired, an additional metering break 74 can be provided on the top surface 58 to cause a slight compression of non-folded edges of a publication moving along the platform 50 before reaching the metering breaks 70, 72. This slight compression of the publication assists in separation of a single copy of the publication for dispensing movement over the edge 68 into a dispensing chute, or channel 76, as will be described in more detail hereinafter.

Figure 5:
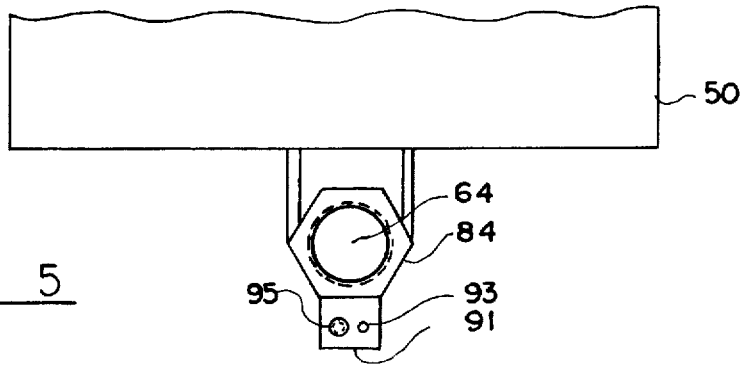
FIG. 5 is a detail view showing an actuating tang for limit switches controlling movement of a push plate.

Mounted in a substantially parallel relationship to the platform 50 is a motor deck 80 (see FIG. 2) which supports an operational portion of the publication advancing mechanism. A bracket 82 is fixedly attached to the deck 80 at its distant end, the bracket 82 extending at a right angle outwardly from the top surface of the deck 80. A lead screw bushing 86 surrounds the distant end of the lead screw 64 and allows securing thereof to the bracket 82. The bushing 86 is mounted to the bracket 82. An opposite end of the lead screw 64 carries a bushing 90 and a coupling 92 which allows a securing of that end of the lead screw 64 within a motor supporting bracket 94. A limit switch 88 is mounted on the deck 80 adjacent the lead screw bushing 86. A similar limit switch 89 is mounted on the deck 80 at a location which the nut 84 reaches when the last copy of a publication resting on the platform 50 is being dispensed. Each limit switch 88 and 89 is activated by downwardly extending tang 91, when the lead screw 64 rotates. The tang 91 is carried by the nut 84 and is fixedly secured thereto by suitable means, such as welding or the like. The tang 91 is provided with two adjusting screws 93 and 95 for the limit switches 88 and 89. (See FIG. 5) The adjusting screw 93, 95 allow to control the time an position when the limit switches 88 and 89 become activated by contact with the tang 91.

A gearmotor 96 is schematically illustrated in FIG. 2, the gearmotor 96 being operationally connected to the lead screw 64 through the coupling 92.

A push plate 100 extends at a right angle to the support plate 50, the push plate 100 being adapted for pushing the publication copies along the support plate 50 from a distant end thereof toward the dispensing edge 68. The push plate 100 has a bottom portion 102 which extends in a parallel relationship to the bearing plate 50 to a distance sufficient to clear the metering breaks 70, 72, and 74. The horizontal portion 102 is connected, through the nut 84, to the lead screw 64 and facilitates advancement of the push plate 100 during operation of the vending machine.

As can be better seen in FIG. 2, the push plate 100 moves to a position shown in phantom lines and the printed publications that rest on top of the plate 50 are moved toward the dispensing edge 68.

The chute 76 which allows dispensing of the advanced printed publications into the dispensing pocket 44 is a four-sided enclosure, which is defined, in part, by the wall 56, and a second wall 104 that is oriented in a substantially parallel relationship to the wall 56 and is secured to the side walls of the housing 12 by suitable means, such as spot welding. Of course, other means of securing the wall 104 can be employed, if desired. The wall 56 is secured, such as by bolt, to the inclined plate 46 at the lower part of the wall 56.

Figure 4:
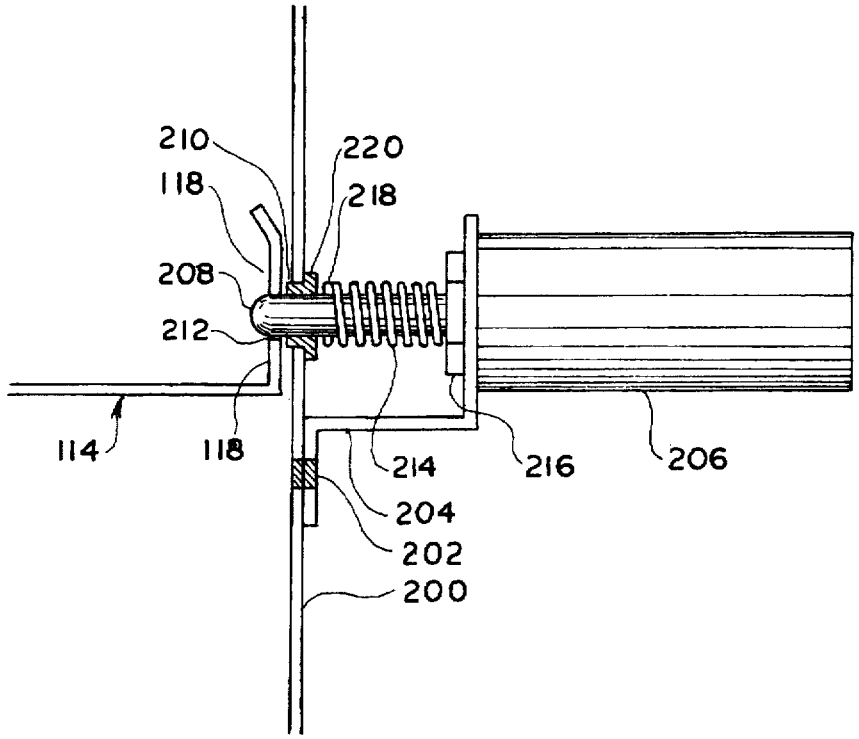
FIG. 4 is a detail view illustrating a release mechanism of a trap door on which a display copy of the publication rests.

Mounted behind the window 24 is a display copy pocket 110 which comprises a vertically oriented back plate 112 secured in a substantially parallel relationship to the window 24, and a trap door 114 which is pivotally mounted in a transverse relationship to the back plate 112. The trap door 114 pivots, or swivels about a pivot point 116. As can be seen in FIG. 4, an internal bulkhead 200 extends vertically within the housing 12. A mounting bracket 202 is fixedly attached, such as by spot welding or other suitable means at 204 to the bulkhead 200. A solenoid 206 is provided with an outwardly extending solenoid nail 208 which has a discreet length suitable to pass through an opening 210 formed in the bulkhead 200 and through an opening 212 formed in a return plate 118 of the trap door 114.

A compression spring 214 is mounted in a surrounding relationship about a portion of the solenoid nail 208. One end of the spring 214 urges against a mounting nut 216, while the other end urges against a spring retainer ring 218. A conventional bearing member 220 is fitted about the opening 210, between the spring retainer ring 218 and the trap door return plate 118.

When the solenoid 206 is activated by the central control means, signalling that the entire inventory of the publications resting on the plate form plate 50 has been dispensed, the solenoid nail 208 is withdrawn from the trap door return plate 118 until the nail 208 reaches the end of the bearing member 220. The trap door 114 is then allowed to drop by pivoting about the pivot point 116, and the display copy of the publication drops, by gravity, into the dispensing pocket 44. Normally, the trap door 114 is oriented horizontally, supporting the display copy behind the window 24.

Once the display copy descends into the dispensing pocket 44, it can be retrieved by the buyer through the dispensing opening 26. The compression spring 214 then returns the nail, or pin 208 into its engagement with the return 118.

The window 24 is securely connected to the front outside wall 22 of the housing 12, preferably without any screws or bolts. In a preferred embodiment, a resilient, flexible gasket 122 with corresponding slots or cut-outs is used for attachment of the window 24 to the front wall 22. If desired, a reinforcement member 124 can be secured to a lower part of the front wall 22, and another reinforcement member 126 can be secured to the upwardly turned lip 42 of the bottom plate 40.

The apparatus 10 of the present invention is provided with a number of limit switches that facilitate dispensing of the printed publications one at a time, while preventing theft of the newspapers and deterring vandalism. The first limit switch 128 is operationally connected to the access door 18 which can be in the form of a mechanical limit switch to be located in the hinge of the access door. When the circuit of the access door limit switch is closed, a control unit 130, which is operationally connected to the motor, and schematically illustrated in FIG. 2, will send an activation signal to the motor and advance the push plate 100 to a ready-to-vend position.

A second limit switch 132 is mounted on the platform 50 adjacent the metering breaks 70,72 and responds to a contact with the publication which is advanced along the platform plate 50. Once the limit switch 132 is contacted by a lower edge of the publication that rests on the plate 50, the limit switch 132 sends a signal to the control unit 130 to stop advancement of the push plate 100, so that the publication is in a ready-to-vend position. The limit switch 132 can be a mechanical limit switch, or other suitable means of transmitting a signal to the control unit 130.

A limit control switch 134 is a transducer that consists of two elements: a light emitting element and a light receiving element. The limit control switch 134 is mounted on the wall 104 adjacent the dispensing edge 68 of the platform 50. When a single publication drops down the chute 76, it will temporarily interrupt the light flow from the light emitting means to the light receiving means. A signal is then transmitted to the control unit 130 where it is processed and sent to the gearmotor 96. Of course other types of transducers can be used. For example, a conventional inductive proximity sensor can be substituted for an optical transducer described above.

In response to the signal from the limit switch 134, the rotation of the motor shaft is reversed for a brief period of time, for example one quarter to one half of a second, to reverse the direction of the movement of the push plate 100 and allow the remainder of the publications to move slightly back on the platform plate 50. This movement relives pressure on the forwardmost copy of the publication and, due to the inclined position of the platform plate 50, prevents inadvertent vending of the next publication by gravity.

Another limit switch 89 is located near the extreme limits of travel of the push plate 100 and the support 102. The limit switch 89 is designed to stop advancement of the plate 100 toward the dispensing edge 68. Once the push plate 100 reaches its outermost position, a signal is sent to the control unit 130 and to the gearmotor 96 to stop rotation of the motor shaft and causes the control unit 130 to direct power to solenoid 206 momentarily. At that time, all publications resting on the platform plate 50 will have been dispensed, and the only copy left in the vending machine is the display copy behind the window 24. When activated, solenoid 206 operationally connected to the pin 208 withdraws the pin from the return plate 118 therefore allowing the trap door 114 to open by gravity and drop the last publication into dispensing area 44. At this time the control unit will reverse the gearmotor 96 and lead screw 64 to return the push plate 100 to the original position. The switch 88 can be a mechanical switch, or any other suitable means of sending a signal to the motor to stop rotation of the shaft.

The return of the push plate 100 to the original position will cause another limit switch 88 to be contacted by the bracket 82 and send a signal to the control unit 130 to remain inactive until re-stocked by service personnel.

Conventionally, a vending machine is provided with a coin counting mechanism which is located behind the coin receiving slot 28. The coin counting mechanism, not shown in the drawing, activates a limit switch 134 when the first coin is deposited into the slot 28. The coin counting mechanism activates the motor as soon as the exact amount of money has been deposited into the vending machine. The activated motor causes advancement of the push plate 100 for dispensing of the forward copy of the publication. The coin counting mechanism can be designed with a means to allow resetting of amount of payments to cover the cost of the publication. For example, the cost of a daily newspaper can be selected by moving a specially provided switch in one direction, while the setting of the coin amount for a Sunday newspaper can be made by moving the switch into a different position. If desired, a toggle switch can be provided for immediate switching between the two preferred prices. The control unit 130 can be provided with a manual override switch, to reset the apparatus 10, similar to a limit switch 89, that would enable the electrical circuit to function in an event anything less than a total sellout of the publications is present.

The vending machine 10 further comprises a means for manually resetting the trap door 114 after the buyer purchases the display copy of the publication.

Figure 6:
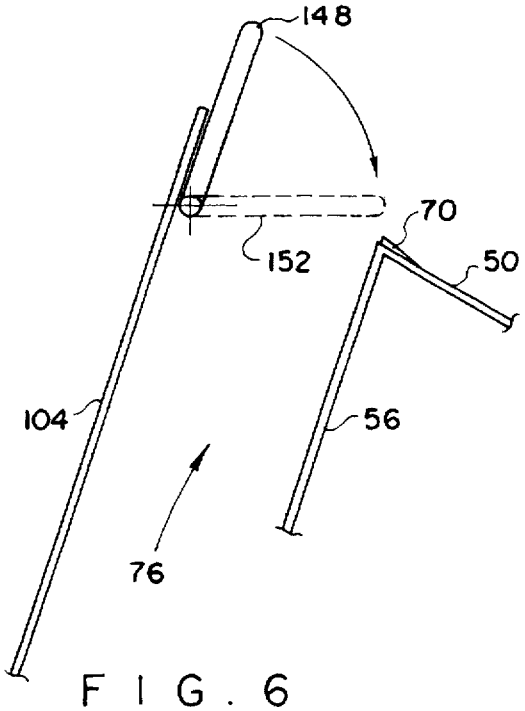
FIG. 6 is a detail view showing a block gate which forms a part of an anti-tilting mechanism.

The vending machine 10 is further provided with a means for preventing unauthorized dispensing of publications when the vending machine is tilted. The mechanism which reacts to tilting of the vending machine 10 is shown schematically in FIGS. 6 and 7. It is comprised of a chute blocking member 148 located between the walls 104 and 56 of the chute 76. The blocking member 148 is normally in a position oriented in a general parallel relationship to the wall 104. However, when the vending machine 10 is tilted or violently shaken, a chute block gate actuator mechanism 150 causes movement of the chute block gate, or member 148 to a position shown in phantom lines 152 in FIG. 6. The blocking door 148 will thereby effectively prevent dispensing of publication through the chute 76 and will retain the publications at the dispensing edge 68.

The chute block actuator mechanism 150 comprises a solenoid 154 provided with a pin, or nail 156 extending outwardly therefrom. The solenoid is supported on a mounting bracket 158 which, in turn, is fixedly attached, such by spot welding at 160 to an internal bulkhead (not shown).

Figure 7:
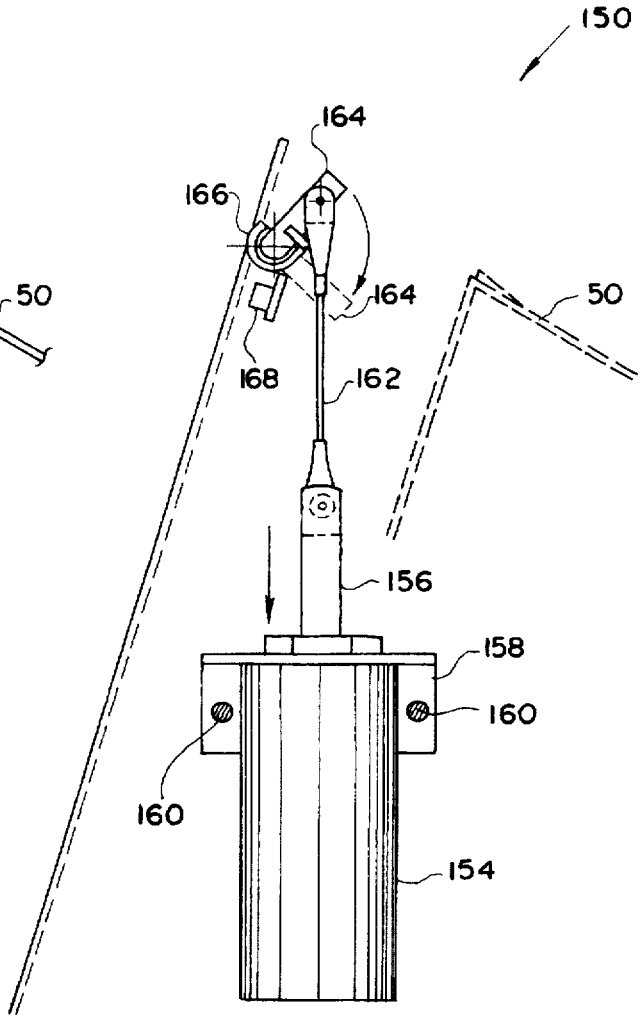
FIG. 7 is a detail view showing a block gate actuator assembly.

A cable 162 connects the pin, or nail 156 to a gate lever 164, and pulls the gate lever 164 to a position shown in phantom lines in FIG. 7 when the solenoid 154 is actuated. A torsion spring 166 usually keeps the gate block 148 in an open position, as shown in solid lines in FIG. 6. When the solenoid 154 is actuated, the pin, or nail 156 retracts into the solenoid body, pulling the cable 162 down. The cable 162 can be substituted, if desired, by a solid rod with articulating joints.

Figure 8:
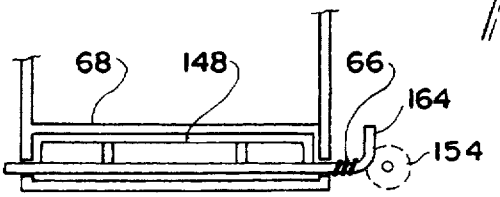
FIG. 8 is a detail top view showing the block gate and a gate lever of the anti-tilting mechanism.

As can be better seen in FIG. 8, the gate block lever 164 is fixedly attached to the gate block member 148. When the gate lever 164 is pulled down, the chute block gate member 148 is moved, against the force of the torsion spring 166 into a position blocking the chute 76 and preventing dispensing of a publication. A spring stop 168 limits movement of the torsion spring 166, to facilitate actuation of the solenoid 154, a tilt switch 176 is provided in operational relationship to the solenoid 154.

The tilt switch can be a mercury-filled switch that can be carried on an inside surface of the housing wall. The solenoid 150 is an electrical mechanical, spring-return pull type solenoid located near the top of the dispensing chute. The solenoid rotates an advancing lever, moving the block door 148 into a position closing the chute 76 until such time as the solenoid 150 is timed out by the tilt switch circuitry.

If desired, the tilt switch 146 can be connected to an audio alarm system which can be positioned within the housing 12 and operationally connected to the tilt switch 146. When the vending machine 10 is tilted to a degree in excess of that preset by the mercury-filled switch, the audible alarm will produce a piercing sound which will help deter vandalism or theft of the vending machine 10.

The apparatus 10 of the present invention prevents unauthorized access to the entire inventory of the housing 12 by dispensing one printed publication at a time. Additionally, the reverse movement of the push plate 100 after dispensing of one copy of the publication prevents undesirable vending of more than one copy of the publication in response to the depositing of the amount of money for one copy only. This return movement of the push plate 100 relieves pressure on the foremost copy of the publication and allows a vending machine operator to prevent loss of even a single copy.

The vending machine 10 in accordance with the present invention is self-contained, it is powered by a battery (not shown) or by a solar powered unit, which is incorporated into the operational system of the vending machine. As a result, the vending machine 10 can be positioned indoors or outdoors, away from sources of A/C power to function independently even if municipal power supply is interrupted.

Various materials can be employed for manufacturing of the vending machine 10. For example, the metering breaks 70, 72, and 74 can be provided with bead blasted aluminum surface, while the platform plate 50 can be made from a strong metal with a smooth polished top surface, for example a chrome plated metal or stainless steel. The window 24 can be made a shatter proof material, such as acrylic or Lexan®, or any other sturdy material which would prevent easy access to the interior of the vending machine.

Many changes in the specifications can be made in the design of the present invention without departing from the spirit thereof. I, therefore, pray that my rights to the present invention be limited only by the scope of the appended claims.

I claim:

1. A vending apparatus for dispensing a single copy of a media unit, comprising:

a platform plate having an upper surface for supporting a plurality of media units;

a push plate slidably movable along the platform plate, said push plate exerting a moving force on said media units in response to a signal received from a control means;

a driving means for advancing said push plate along said platform plate toward a dispensing channel formed adjacent a forward edge of the platform plate;

a means for detecting movement of a single copy of a media unit through the dispensing channel and reversing movement of said driving means for a predetermined period of time, so as to allow movement of remaining media units a distance away from the forward edge of the platform plate.

2. The apparatus of claim 1, wherein said detecting means comprises a light emitting means mounted in the dispensing channel for emitting a flow of light and a light receiving means, said light receiving means transmitting a signal to the control means when the flow of light is temporarily blocked by a single copy of a media unit moving through the dispensing channel.

3. The apparatus of claim 1, further comprising means for dispensing a display copy of a media unit after an entire inventory of the media units resting on the platform plate has been dispensed.

4. The apparatus of claim 3, wherein said means for dispensing the display copy comprises a support plate moveable, between a first position supporting the display copy and the second position allowing dispensing of the display copy, and a means for moving the support plate to the second position.

5. The apparatus of claim 4, wherein said means for moving the support plate to the second position comprises a securing pin normally retaining the support plate in the first position and adapted for movement out of engagement with the support plate in response to a signal received from the control means.

6. The apparatus of claim 5, further comprising a switch means for detecting movement of the push plate to the dispensing edge of the platform plate and activating the control means to cause the push plate to move to a start position contemporaneously causing the securing pin to move out of engagement with the support plate.

7. The apparatus of claim 6, wherein said switch means for detecting movement of the push plate comprises a limit switch.

8. The apparatus of claim 1, further comprising means for preventing of dispensing of the media units when said apparatus is tilted beyond a predetermined degree.

9. The apparatus of claim 8, wherein said means for preventing dispensing of the media units comprises a normally open door mounted in the dispensing channel, a tilt sensor means for detecting movement of the apparatus beyond a pre-determined degree and a means for moving the door to a position blocking the dispensing channel in response to a signal transmitted by the tilt sensor means.

10. The apparatus of claim 9, wherein said door is positioned at a level generally aligned with an upper surface of the platform plate.

11. A vending apparatus for dispensing a single copy of a media unit, comprising:

a platform plate having an upper surface for supporting a plurality of media units;

a push plate slidably movable along the platform plate, the push plate exerting a moving force on said media unit in response to a signal received from the control means;

a driving means for advancing the push plate along the platform plate toward a dispensing channel formed adjacent a forward edge of the platform plate;

a means for detecting movement of a single copy of a media unit through the dispensing channel and reversing movement of the driving means for a predetermined period of time, so as to allow movement of remaining media units a distance away from the forward edge of the platform plate, said detecting means comprising a light emitting means mounted in the dispensing channel for emitting a light flow and a light receiving means, the light receiving means transmitting a signal to the control means when the flow of light is temporarily blocked by a single copy of the media unit moving through the dispensing channel; and a means for dispensing a display copy of a media unit after an entire inventory of the media units resting of the platform plate has been dispensed.

12. The apparatus of claim 11, wherein said means for dispensing the display copy comprises a support plate moveable between a first position supporting the display copy and a second position allowing dispensing of the display copy, and a means for pivotally moving the support plate to the second position, said means for moving the support plate comprising a securing pin normally retaining the support plate in the first position and adapted for movement out of engagement with the support plate in response to a signal received from the control means.

13. The apparatus of claim 12, further comprising a switch means for detecting movement of the push plate to the dispensing edge of the platform plate and activating the control means to cause the push plate to move to a start position contemporaneously causing the securing pin to move out of engagement with the support plate.

14. The apparatus of claim 11, further comprising means for preventing dispensing of the media units when the vending apparatus is tilted beyond a predetermined degree.

15. The apparatus of claim 14, wherein said means for preventing dispensing of the media unit comprises a normally open door mounted in the dispensing channel in general co-alignment with a top surface of the platform plate, a tilt sensor means for detecting movement of the vending apparatus beyond the pre-determined degree and a means for moving the door to a position blocking the dispensing channel in response to a signal transmitted by the tilt sensor means.

16. A vending apparatus for dispensing a single copy of a media unit, comprising:

a platform plate having an upper surface for supporting a plurality of media units;

a push plate slidably moveable above the platform plate, the push plate exerting a moving force on said media units in response to a signal received from a control means;

a driving means for advancing said push plate above the platform plate to a dispensing channel formed adjacent a forward edge of the platform plate;

a means mounted on the platform plate for separating a single forward copy of a media unit prior to movement of the single copy into the dispensing channel;

a means for detecting movement of the single copy of the media unit through the dispensing channel;

a means for dispensing a display copy of a media unit after an entire inventory of the media units resting on the platform plate has been dispensed; and a means for preventing dispensing of the media units when the apparatus is tilted beyond a pre-determined degree.

17. The apparatus of claim 16, wherein said means for separating a single copy of the media unit comprises at least one metering break member mounted adjacent the dispensing edge of the platform plate.

18. The apparatus of claim 16, wherein said means for detecting movement of a single copy of the media unit through the dispensing channel is adapted for transmitting a signal to the control means to reverse movement of the driving means for a predetermined period of time, so as to allow movement of the remaining media units a distance away from the forward edge of the platform plate.

19. The apparatus of claim 16, wherein said detecting means comprises a light emitting means mounted in the dispensing channel for emitting a light flow and a light receiving means for receiving the light flow, the light receiving means transmitting a signal to the control means when the flow of light is temporarily blocked by a single copy of the media unit moving through the dispensing channel.

20. The apparatus of claim 16, wherein said means for dispensing the display copy comprises a support plate pivotally moveable between a first position supporting the display copy and a second position allowing dispensing of the display copy, and a means for moving the support plate to the second position, said means for moving the support plate to the second position comprising a securing pin normally retaining the support plate in the first position and adapted for movement out of engagement with the support plate in response to a signal received from the control means.

21. The apparatus of claim 16, wherein said means for preventing dispensing of the media units comprises a normally open door mounted in the dispensing channel at a level generally aligned with a top surface of the platform plate, a tilt sensor means for detecting movement of the apparatus beyond a pre-determined degree, and means for moving the door to a position blocking the dispensing channel in response to a signal transmitted by the tilt sensor means.

* * * * *